US007789201B2

(12) United States Patent
Arzberger

(10) Patent No.: US 7,789,201 B2
(45) Date of Patent: Sep. 7, 2010

(54) GEAR UNIT AND METHOD FOR CONTROLLING AN INTERNAL PRESSURE IN THE GEAR UNIT

(75) Inventor: Maximilian Arzberger, Igenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 1028 days.

(21) Appl. No.: 10/980,150

(22) Filed: Nov. 4, 2004

(65) Prior Publication Data

US 2005/0091885 A1 May 5, 2005

(30) Foreign Application Priority Data

Nov. 4, 2003 (DE) ..... 103 51 386

(51) Int. Cl.
*F16H 57/04* (2010.01)
*E21B 21/00* (2006.01)

(52) U.S. Cl. ..... 184/6.12; 184/7.4; 37/347; 175/25

(58) Field of Classification Search ..... 184/1.5, 184/7.4, 6.12, 26, 54, 55.1, 57; 37/347; 425/138, 26; 138/31
See application file for complete search history.

(56) References Cited

U.S. PATENT DOCUMENTS

| | | | | |
|---|---|---|---|---|
| 2,401,791 | A * | 6/1946 | Overbeke | 138/30 |
| 3,613,734 | A * | 10/1971 | Elmer | 138/31 |
| 3,670,514 | A * | 6/1972 | Breston et al. | 405/160 |
| 3,672,725 | A * | 6/1972 | Johnson | 299/8 |
| 3,770,067 | A * | 11/1973 | Ikeda | 175/95 |
| 3,775,736 | A * | 11/1973 | Koomey | 367/133 |
| 3,843,095 | A | 10/1974 | Rupert | |
| 3,918,498 | A * | 11/1975 | Schneider | 138/31 |
| 4,423,567 | A | 1/1984 | Raven, III | |
| 4,473,754 | A | 9/1984 | Joy | |
| 4,579,484 | A * | 4/1986 | Sullivan | 408/56 |
| 4,757,878 | A | 7/1988 | Iino et al. | |
| 6,012,878 | A * | 1/2000 | Hicks | 408/1 R |
| 6,202,753 | B1 * | 3/2001 | Baugh | 166/364 |
| 6,418,970 | B1 * | 7/2002 | Deul | 138/31 |
| 7,020,553 | B2 * | 3/2006 | Nakamura et al. | 701/50 |
| 2001/0032754 | A1 * | 10/2001 | Bedi et al. | 184/1.5 |
| 2002/0056275 | A1 * | 5/2002 | Weber | 60/413 |
| 2003/0178200 | A1 * | 9/2003 | Fox et al. | 166/341 |
| 2004/0159101 | A1 * | 8/2004 | Bruun | 60/413 |
| 2005/0022996 | A1 * | 2/2005 | Baugh | 166/363 |

FOREIGN PATENT DOCUMENTS

| | | |
|---|---|---|
| EP | 0 518 293 B1 | 12/1992 |
| GB | 2 309 951 A1 | 8/1997 |
| JP | 7138980 | 5/1995 |
| JP | 8270007 | 10/1996 |

(Continued)

*Primary Examiner*—Bradley T King
*Assistant Examiner*—Thomas Irvin
(74) *Attorney, Agent, or Firm*—Jacobson Holman PLLC

(57) ABSTRACT

The invention relates to a gear unit, in particular for foundation engineering devices, comprising a gear housing and a pressure device for changing an internal pressure present in the gear housing. For a precise pressure balance to the environmental pressure it is intended that an active setting device is arranged which can be controlled by a control device in order to change the internal pressure. The invention further relates to a method for pressure balance related thereto.

17 Claims, 3 Drawing Sheets

FOREIGN PATENT DOCUMENTS

Figure 1:
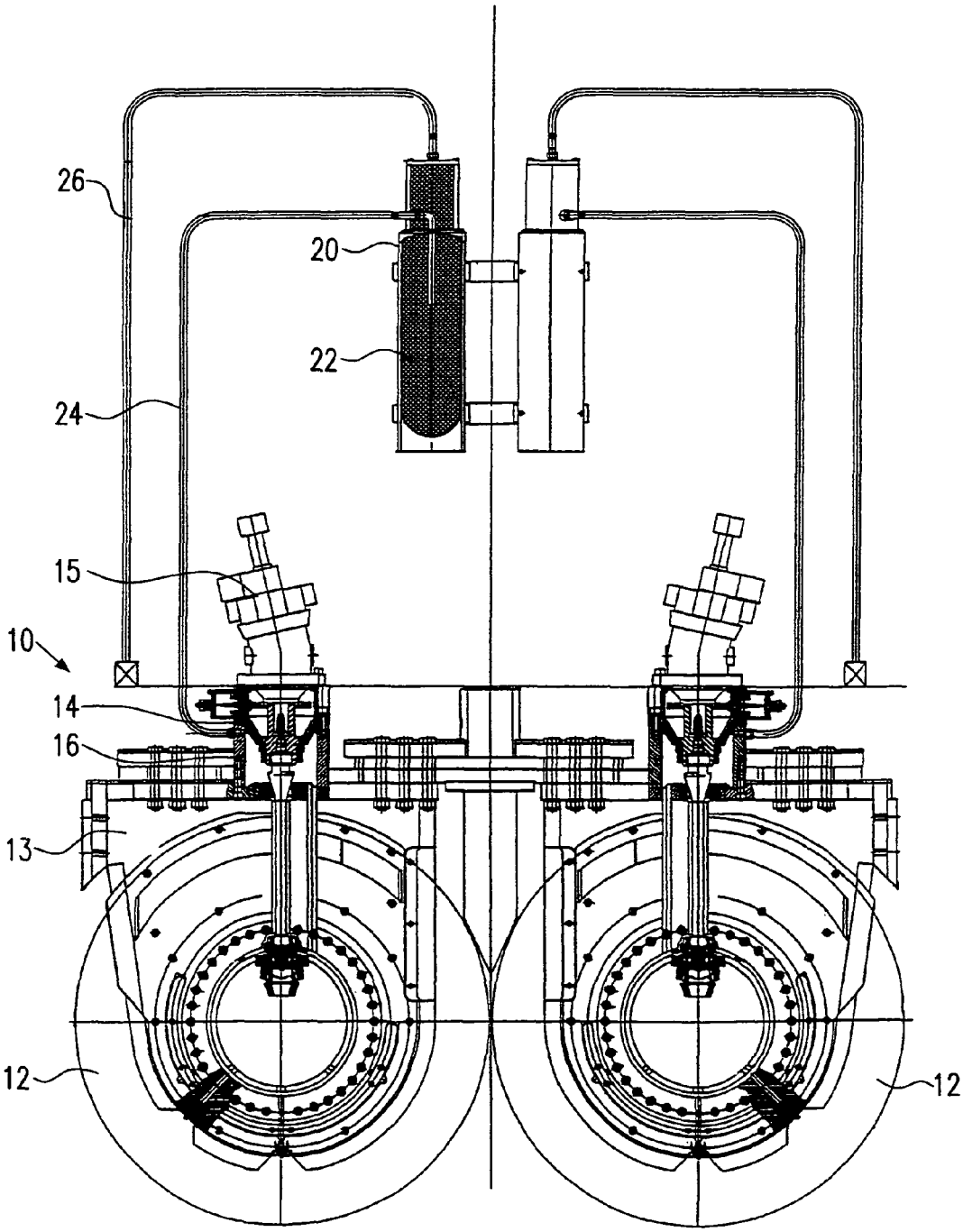

| | | |
|---|---|---|
| JP | 9299455 | 11/1997 |
| JP | 10331187 | 12/1998 |
| JP | 2001170408 | 6/2001 |
| JP | 2003248889 | 9/2003 |
| RU | 2125666 | 1/1999 |
| RU | 2185995 | 7/2002 |

* cited by examiner

GEAR UNIT AND METHOD FOR CONTROLLING AN INTERNAL PRESSURE IN THE GEAR UNIT

The invention relates to a gear unit, in particular for foundation engineering devices, comprising a gear housing and a pressure device for changing an internal pressure present in the gear housing. The invention further relates to a method for controlling an internal pressure in a gear unit.

In gear units operating under water or any other kind of increased environmental pressure a pressure balance needs to be carried out in order to adjust the oil pressure in the gear unit to the external environmental pressure. Otherwise there would be the danger of greater pressure differences between the housing interior and the environment. In such case water might penetrate from the outside into the gear unit due to the pressure difference. Without such a pressure balance a considerable effort would have to be made to seal the gear unit against the penetration of fluids from the outside.

Such a pressure balancing system provided on a gear unit is known from the DE 2 162 314 A. For this purpose an opening is provided at the gear housing, which is sealed with respect to the environment by means of a flexible membrane. In the case of a higher environmental pressure the membrane is able to bend inwards and thereby bring about a pressure balance inside the gear unit. However, in the case of rough environmental conditions, as they prevail for instance on construction sites for foundation engineering drilling devices, such a system is susceptible to damage.

From the EP 0 518 293 B1 a trench cutter is known, the bearing seals of which are provided with a hydraulic pressure balancing device. To this end a slidable piston is provided, on the one end of which the environmental pressure can act. The other end of the slidable piston acts on an oil reservoir which can thereby generate a hydraulic counter-pressure onto the bearing seals in the case of a corresponding pressure increase of the environment.

In this known device a considerable improvement of robustness is achieved in comparison to a flexible membrane that has a poor stability from a mechanical point of view, but even in this case there is the risk that the movability of the piston or the connection to the external environment of the piston is affected adversely on account of a contamination under construction site conditions. A reliable pressure balance could then no longer be guaranteed.

The invention is based on the object to provide a gear unit and a method for controlling the internal pressure in a gear unit, which permit a reliable pressure change in the gear unit whilst having a simple and robust arrangement.

In accordance with the invention the object is solved on the one hand by a gear unit having the features of claim 1 and on the other hand by a method having the features of claim 12. Preferred embodiments are stated in the respective subclaims.

The gear unit according to the invention is characterized in that an active setting device is provided which can be controlled by a control device to change the internal pressure. A basic idea of the invention is to transfer from the passive pressure adjustment in the prior art, in which the environmental pressure changes the internal pressure directly through a membrane or a piston, to an active, controlled pressure setting. Through a control device the power-driven setting device is activated which changes the internal pressure in the gear housing according to the control signal.

Basically the pressure change can be brought about in various ways, for example by changing the volume of the gear housing through an adjustable piston. A preferred embodiment according to the invention resides in the fact that the setting device is designed for changing the filling of the gear housing. In this way a quick and selective pressure change can be effected in a relatively simple way.

By preference, the setting device has a pump and/or a compensating tank which are connected to the gear housing through lines in order to supply and/or discharge a fluid. Both the gear oil provided for the gear unit and air, which is usually also present in a gear unit, can be provided as fluid for influencing pressure. For certain applications a specific pressure fluid may be useful that can have specific physical properties with regard to compressibility and temperature behaviour as well as specific corrosion-preventive properties.

According to an improvement of the invention it is advantageous that a defined pressure can be set in the compensating tank, with the supply of fluid into the gear housing being controllable by a control valve. In the compensating tank a defined excess pressure can be present with respect to the housing interior so that fluid can be introduced into the gear housing in the desired quantity at any time. For a pressure decrease a vent valve can be provided that is also controllable by the control device.

For an efficient pressure setting it is intended according to the invention that the setting device has a volume changing device, in particular a piston, to change an internal volume of the compensating tank. The pressure setting takes place in the compensating tank, which is in fluid connection with the gear housing so that the pressure inside the compensating tank corresponds to the pressure in the gear housing.

A particularly practicable and cost-saving design resides in the fact that the compensating tank is filled at least partly with gear oil that serves as fluid for changing the pressure. In order to avoid any contamination of the gear oil it is intended according to the invention that a second fluid is provided in the compensating tank, which is separated from the gear oil by a separating element, such as a piston, a membrane or a bubble. The second fluid, which is preferably air, also serves to balance out temperature variations of the gear oil that occur during operation.

For a smooth pressure change in the gear housing it is intended according to the invention that a damping member is provided, through which in particular a pressure transmission to the gear oil can be damped, wherein the damping member provides in particular a separating element with arranged spring or a gas volume.

For a precise pressure adjustment it is advantageous in accordance with the invention that a pressure sensor is provided for measuring a pressure inside and/or outside the gear housing, which is in signalling contact with the control device. In this manner the environmental pressure can be measured by an external pressure sensor and supplied to the control device. With these measured values the control device is able to adjust the internal pressure of the housing in the desired way, and here an internal pressure sensor may serve as a feedback device. Hence, not only a pure control of the internal pressure can be effected but also a regulation.

Another preferred embodiment of the invention resides in the fact that an oil-level measuring device is provided for detecting a gear oil level in the compensating tank, which is in signalling contact with the control device in particular. As a result, the gear oil level in the compensating tank can be detected in a particularly easy way and used for a reliable oil level measurement. The measuring device can also be coupled to a temperature sensor so that possible volume changes of the gear oil that are caused by temperature can be taken into consideration, too. Thus, a particularly reliable filling level and leakage monitoring of the gear housing is possible.

Basically the gear unit according to the invention can be used for various applications, in which gear units are employed under conditions of excessive pressure or sub-atmospheric pressure, as for example under water.

The use of the gear unit in accordance with the invention in a foundation engineering device, in particular in a trench cutter, proves to be particularly advantageous. The arrangement according to the invention dispenses with the need for sensitive movable mechanical parts that are exposed to the rough environmental conditions so that especially in foundation engineering devices a reliable pressure setting and pressure adjustment of the internal pressure of the gear unit is possible.

The method in accordance with the invention is characterized in that the internal pressure is changed by means of an active setting device that is controlled by a control device. As a result of this method according to the invention the advantages set out above with regard to a reliable pressure setting and pressure adjustment can be achieved.

According to a preferred embodiment it is intended that an external pressure is measured at the gear housing by means of an external pressure sensor and the internal pressure is controlled as a function of the measured external pressure. On account of the small constructional size and the relatively low costs of pressure sensors a plurality of external pressure sensors can preferably be provided so that a particularly high precision of measurement is guaranteed.

Alternatively or in addition, the external pressure can also be determined in a trench cutter for instance by means of the depth position of the device, as the external pressure is proportionate to the depth of the device within a fluid. Through suitable sensors arranged for example at the winch the environmental pressure can be determined by means of the position so that a pressure adjustment is also possible without an external pressure sensor.

For a particularly reliable pressure setting by means of regulation it is intended according to the invention that a measurement of the internal pressure is carried out in the gear housing by means of an internal pressure sensor and that the internal pressure is regulated by the control device.

Another advantage of the invention resides in the fact that the internal pressure in the gear housing is controlled and/or regulated such that it is equal to the measured external pressure or smaller or larger than the measured external pressure by a defined pressure difference. Thus, a defined excessive or low pressure can always be set in the gear housing by means of the control device. In the case of a predetermined excessive pressure it is ensured that no fluid is able to penetrate from the outside into the gear housing. When works are being carried out in sensitive environments, for example in ground-water reserves, it may be appropriate to set a slight sub-atmospheric pressure in the gear housing so that a leakage of gear oil is prevented with a very high degree of certainty.

Figure 1A:
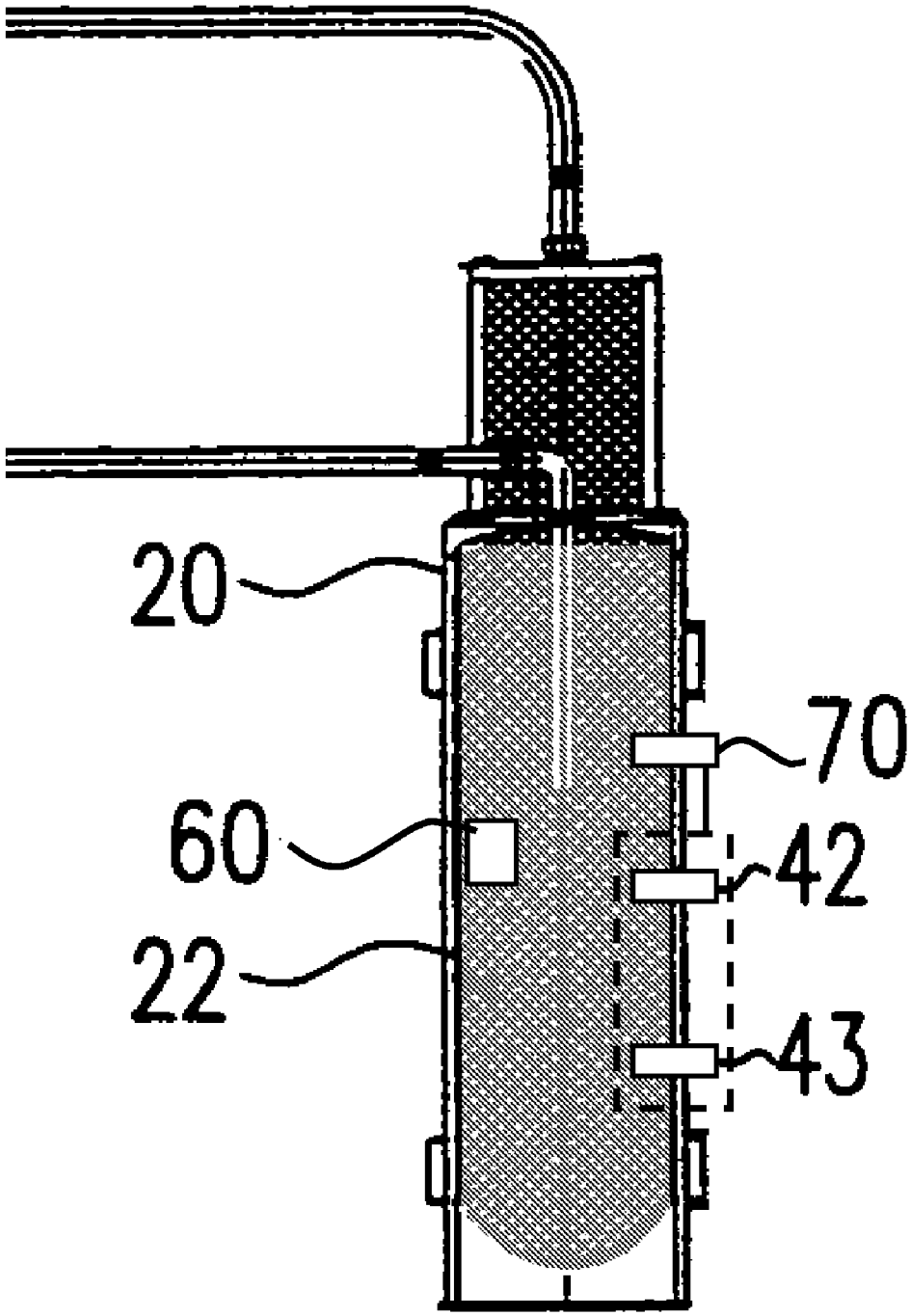

In the following a detailed description of the invention will be given by way of preferred embodiments that are schematically shown in the drawings. In the drawings:

FIG. 1 shows an extremely schematized partial side view of a trench cutter comprising a gear unit according to the invention;

FIG. 1*a* shows an enlarged view of the compensating device of FIG. 1; and FIGS. 2*a* to 2*e* show schematic cross-sectional views of various compensating tanks for the invention.

In FIG. 1 a trench cutter 10 designed according to the invention is shown which has two cutter wheels 12 on either side of a gear shield 13. On the gear shield 13 a gear unit 14 according to the invention is located which transmits the torque of the hydraulic drive 15 to the cutter wheels 12. The gear unit 14 extends as far as into the centre of the cutter wheels 12, where only a part of the toothed gear is shown. Due to the symmetrical construction of a trench cutter 10, the gear arrangement will be explained hereinafter with respect to the left hand-side arrangement of the cutter wheels 12 only.

To change the pressure inside a gear housing 16 of the gear unit 14, an active setting device 20 is provided for the pressure change. In the present embodiment the active setting device 20 has a compensating tank 22, which is connected to the inside of the gear housing 16 through a fluid line 24. In the compensating tank 22 a desired pressure can be generated by a control device 60, and said pressure is transmitted via the fluid line 24 to the internal pressure of the gear unit 14. In this manner a desired pressure can be set inside the gear unit 14, which can be adjusted for example to an external environmental pressure. This way a pressure difference between the inside and the outside of the gear unit can be avoided in a trench cutter 10 that has to operate in trenches that are filled with suspension and have a depth of up to 100 m. Hence, despite the high environmental pressure a penetration of fluid or suspension into the gear housing 16 can be prevented without specific sealing measures on shaft seals and housing seals of the gear unit 14.

As shown in FIG. 1*a*, an oil-level measuring device including sensors 42 and 43 is provided for detecting a gear oil level in the compensating tank 22, which is in signalling contact with the control device 60 in particular. As a result, the gear oil level in the compensating tank 22 can be detected in a particularly easy way and used for a reliable oil level measurement. The measuring device can also be coupled to a temperature sensor 70 so that possible volume changes of the gear oil that are caused by temperature can be taken into consideration, too. Thus, a particularly reliable filling level and leakage monitoring of the gear housing is possible.

During the extraction of the trench cutter 10 from the trench the pressure inside the gear housing 16 can be reduced again according to the change of depth, and here the compensating tank 22 can be vented or filled via a venting line 26 which merges into a ball valve.

Figures 2A, 2B, 2C, 2D, 2E:
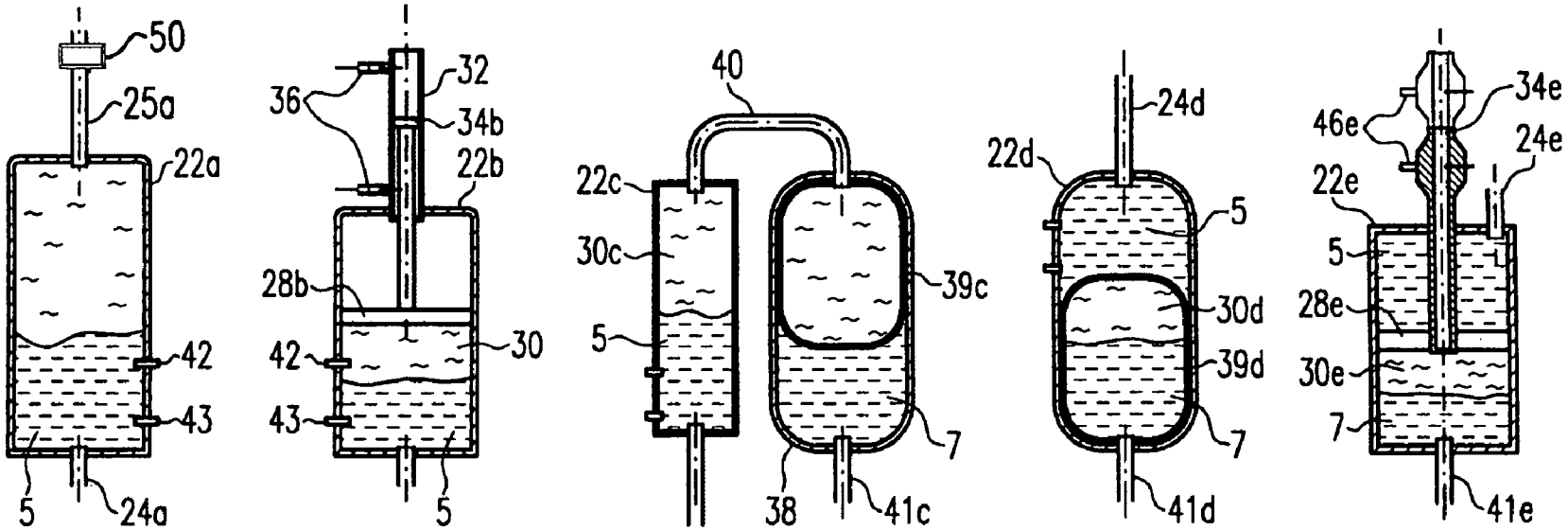

A first embodiment for generating pressure in a compensating tank 22*a* used for the invention is shown in FIG. 2*a*. The cylindrical compensating tank 22*a* is partly filled with a gear oil 5 that corresponds via a fluid line 24*a* with the gear oil in the gear unit. For the pressure setting compressed air can be introduced via a compressed-air line 25*a* into the compensating tank 22*a* by means of a control valve 50 that is controlled by the control device. In the compensating tank 22*a* sensors 42, 43 can be arranged which may also be employed for an oil-level measuring device in addition to the pressure measuring.

According to the alternative embodiment of FIG. 2*b* the pressure of the gear oil 5 in a cylindrical compensating tank 22*b* can also be set by means of a piston 28*b*. Between the piston 28*b* and the gear oil 5 there is a defined quantity of gas 30 which may serve as a damping element in the pressure setting. In particular, the pressure adjustment can take place step-by-step which can be implemented through a simple valve control. The position of the piston 28*b* is effected by means of a hydraulically or pneumatically operated setting cylinder 32 having a piston rod 34*b*. By acting upon the connections 36 in a suitable manner the position of the piston in the compensating tank 22 can be predetermined in a defined manner by the control device.

A hydraulic arrangement is shown in FIG. 2*c*, and here the compensating tank 22*c* is designed like the compensating tank 22*a* of FIG. 2*a*. The pressure line used for the supply of gas is designed as a coupling line 40 which leads to a hydraulic tank 38 that is partly filled with hydraulic oil 7. The gas present in the hydraulic tank 38 is separated from the hydraulic oil 7 by a bubble 39*c*. Through a corresponding supply and discharge of hydraulic oil 7 via the hydraulic line 41*c* it is possible to influence the size of the bubble 39*c* and consequently, via the coupling line 40, the pressure in the compensating tank 22*c* in the desired way.

A simplified embodiment of the arrangement described above is illustrated in FIG. 2*d*. In the compensating tank 22*d* there is provided not only the gear oil 5 but also the hydraulic oil 7 as well as a defined gas quantity 30*d*, which are both separated from the gear oil 5 in an elastic bubble 39*d*. Through the hydraulic line 41*d* the volume of the hydraulic oil 7 in the compensating tank 22*d* can be changed and as a result a corresponding pressure change of the gear oil 5 arranged in the upper portion is brought about, which is in turn connected to the inside of the gear housing through the fluid line 24*d*. The gas volume 30*d* present in the bubble 39*d* serves as a gas receiver to dampen the pressure change.

A similar embodiment is provided in the compensating tank 22*e* in accordance with FIG. 2*e*. In this case, too, a hydraulic oil 7 with a gas quantity 30*e* is located in a lower portion of the compensating tank 22*e*, which are separated through a piston 28*e* from a gear oil 5 arranged above. By supplying hydraulic oil 7 via the hydraulic line 41*e* the pressure inside the compensating tank 22*e* can be changed, whereby the pressure of the gear oil 5 is transmitted via the fluid line 24*e* to the gear oil inside the gear unit. At the same time the extension of the piston rods 34*e* can be determined by a sensor 46*e* as a measure for the gear oil level.

The invention claimed is:

1. A gear unit for foundation engineering devices, comprising:

a gear housing having an internal pressure, a power-driven, active setting device for changing the internal pressure in the gear housing, the active setting device including a compensating tank partly filled with gear oil, a pressure change device for hydraulically generating a change in the pressure of the gear oil in the compensating tank, and a piston for changing the internal volume of the compensating tank, wherein the piston includes a piston rod, a measuring device for measuring the extension of the piston rod and determining the level of the gear oil based on the measured extension of the piston rod, a control device for controlling the pressure change device, fluid communication means providing fluid communication between the compensating tank and the gear housing for changing the internal pressure in the gear housing in response to the pressure change in the gear oil in the compensating tank, by supplying gear oil to the gear housing from the compensating tank and by discharging gear oil from the gear housing to the compensating tank, and damping means provided in the compensating tank for damping a pressure change in the gear oil in the compensating tank generated by the pressure change device and transmitting the dampened pressure change to the gear oil in the gear housing via the fluid communication means, wherein the damping means and the piston separate the gear oil and the pressure change device from each other.

2. The gear unit according to claim 1, wherein the pressure change device comprises:

a second fluid provided in the compensating tank and a separating element in the compensating tank separating the second fluid from the gear oil.

3. The gear unit according to claim 2, wherein the active setting device has a volume changing device for changing the internal volume of the compensating tank.

4. The gear unit according to claim 3, wherein the volume changing device for changing the internal volume of the compensating tank is a piston.

5. The gear unit according to claim 2, wherein a pressure sensor is provided for measuring a pressure at least one of inside and outside the gear housing, and said pressure sensor is in signaling contact with the control device.

6. The gear unit according to claim 2, further comprising an oil-level measuring device for detecting a gear oil level in the compensating tank, said oil-level measuring device being in signaling contact with the control device.

7. A foundation engineering device comprising a trench cutter having a gear unit according to claim 2 provided therein.

8. The gear unit according to claim 2, wherein the damping means is one of a gas and a separating element with a spring.

9. The gear unit according to claim 2, wherein the separating element is one of a piston, a membrane, and a bubble.

10. The gear unit according to claim 2, further comprising for an external pressure sensor for measuring an external pressure at the gear housing, wherein the active setting device controls the internal pressure in the gear housing as a function of the measured external pressure.

11. The gear unit according to claim 2, wherein the active setting device is operable for setting the internal pressure in the gear housing sufficiently below atmospheric pressure to prevent leakage of gear oil therefrom.

12. The gear unit according to claim 2, further comprising:

an oil-level measuring device for detecting a gear oil level in the compensating tank, said oil-level measuring device being in signaling contact with the control device; and a temperature sensor coupled to the oil-level measuring device to enable temperature-induced volume changes of the gear oil to be taken into consideration by the control device in controlling the pressure change device.

13. A method for controlling an internal pressure in the gear unit according to claim 2, comprising the step of changing the internal pressure using the active setting device controlled by the control device.

14. The method according to claim 13, further comprising the steps of:

measuring an external pressure at the gear housing an external pressure sensor and controlling the internal pressure as a function of the measured external pressure.

15. The method according to claim 14, further comprising at least one of controlling and regulating the internal pressure in the gear housing such that it is one of: equal to the measured external pressure, smaller than the measured external pressure by a defined pressure difference, and larger than the measured external pressure by the defined pressure difference.

16. The method according to claim 13, further comprising the steps of:

determining a depth position of the gear housing and controlling the internal pressure as a function of the depth position.

17. The method according to claim 13, further comprising the steps of:

carrying out a measurement of the internal pressure in the gear housing an internal pressure sensor and regulating the internal pressure using the control device.

* * * * *